US005414910A

United States Patent [19]

Herman

[11] Patent Number: 5,414,910

[45] Date of Patent: May 16, 1995

[54] DECORATIVE MULTI-PART ORNAMENTATIONS HAVING A COLLAR ELEMENT

[75] Inventor: Michael Herman, Huntington, N.Y.

[73] Assignee: Berman Pearl Button Company, Inc., New York, N.Y.

[21] Appl. No.: 129,433

[22] Filed: Sep. 30, 1993

Related U.S. Application Data

[63] Continuation-in-part of Ser. No. 44,263, Apr. 7, 1993, Pat. No. 5,315,739, which is a continuation-in-part of Ser. No. 843,457, Feb. 28, 1992, Pat. No. 5,255,417, which is a continuation-in-part of Ser. No. 737,066, Jul. 29, 1991, abandoned, and a continuation-in-part of Ser. No. 805,322, Dec. 10, 1991, abandoned.

[51] Int. Cl.[6] ..... A44B 1/14

[52] U.S. Cl. ..... 24/113 MP

[58] Field of Search ..... 24/90 R, 90 A, 113 R, 24/113 MP, 90 C, 92, 163 K, 90 E, 90 TA; 40/315; 63/2

[56] References Cited

U.S. PATENT DOCUMENTS

| | | | |
|---|---|---|---|
| Re. 32,500 | 9/1987 | Takata | 24/113 MP |
| 56,791 | 7/1866 | Overbaugh . | |
| 316,253 | 4/1885 | Fox . | |
| 327,442 | 9/1885 | Hyde, Jr. . | |
| D. 337,967 | 8/1993 | Wright | D11/226 |
| 748,411 | 12/1903 | Neuberth | 24/90 A |
| 757,744 | 4/1904 | Hornich, Jr. . | |
| 758,758 | 10/1904 | Keplinger . | |
| 1,227,501 | 5/1917 | Styles . | |
| 1,292,588 | 1/1919 | Devine . | |
| 1,659,975 | 2/1928 | Guyot | 24/113 MP |
| 1,867,424 | 4/1932 | Smith | 24/113 MP |
| 1,927,221 | 1/1932 | Schnarr | 63/15 |
| 2,087,074 | 8/1936 | Tucker | 24/113 |
| 2,220,038 | 8/1937 | Kreisler et al. . | |
| 2,354,513 | 11/1942 | Fitzer | 63/15 |
| 2,634,476 | 11/1949 | Mishkin et al. | 24/163 |
| 2,649,634 | 8/1953 | Zelenay | 24/113 R |
| 2,674,107 | 4/1954 | Bodnar | 63/29 |
| 2,860,395 | 10/1955 | Anderson | 24/90 |
| 2,993,250 | 7/1961 | Decker | 24/113 |
| 3,087,215 | 4/1963 | Tworek et al. | 24/113 R |
| 3,091,141 | 5/1963 | Decker | 79/5 |
| 3,133,331 | 5/1964 | Maricorena | 24/230 |
| 3,303,953 | 2/1967 | Frank | 215/38 |
| 3,414,949 | 2/1967 | Andrews | 24/208 |
| 3,439,439 | 9/1966 | Stimson | 40/1.5 |
| 3,500,507 | 9/1967 | Malhenzie et al. | 24/113 |
| 3,543,354 | 8/1970 | Schuchman et al. | 24/41 |
| 3,715,781 | 2/1971 | Salvatori | 24/90 HA |
| 4,471,510 | 9/1984 | DeRosa | 24/90 R |
| 4,481,696 | 11/1984 | Kanzaka | 24/113 R |
| 4,507,344 | 3/1985 | Baughman | 428/99 |
| 4,571,781 | 2/1986 | Kanzaka et al. | 24/95 |
| 4,597,206 | 7/1986 | Benson | 40/1.5 |
| 4,742,696 | 5/1988 | Jenkins | 63/15 |
| 4,793,155 | 12/1988 | Law | 63/2 |
| 4,858,281 | 8/1989 | Watanabe et al. | 24/113 MP |
| 4,891,956 | 1/1990 | MacDonald | 63/3 |
| 4,899,556 | 2/1990 | Ford | 63/14.1 |
| 4,912,829 | 4/1990 | Hickey | 29/453 |
| 4,941,234 | 7/1990 | Watanabe | 24/113 MP |
| 4,959,890 | 10/1990 | Pazurek | 24/113 MP |
| 5,033,168 | 7/1991 | Sbragi | 24/113 |
| 5,093,965 | 3/1992 | Mauras et al. | 24/90 |

FOREIGN PATENT DOCUMENTS

| | | |
|---|---|---|
| 109153 | 5/1988 | China . |
| 132018 | 1/1989 | China . |
| 1050590 | 2/1952 | France . |
| 1525179 | 4/1968 | France . |
| 296164 | 3/1916 | Germany . |
| 701529 | 12/1940 | Germany . |
| 1031730 | 7/1954 | Germany . |
| 1181961 | 11/1964 | Germany . |
| 3614966A1 | 11/1987 | Germany . |
| 468004 | 6/1937 | United Kingdom . |
| 1357885 | 6/1974 | United Kingdom . |
| 2242669 | 10/1991 | United Kingdom . |

*Primary Examiner*—James R. Brittain

*Attorney, Agent, or Firm*—Richard S. Roberts

[57] ABSTRACT

Ornamental assemblies are formed by snap-type action securing elements formed respectively on ornamental bases and caps so that a number of different caps can be attached to a single base to fabricate a number of different assemblies. The assembly has a hollow cap element having top and side walls. The side walls have inner and outer surfaces-which co-terminate at an edge lip. A collar is attached about the inner surface of the side walls of said cap element at the edge lip. A base element is attached to the collar by means for snapping the base element and the collar together. The items of ornamentation may be buttons, buckles or items of jewelry.

20 Claims, 15 Drawing Sheets

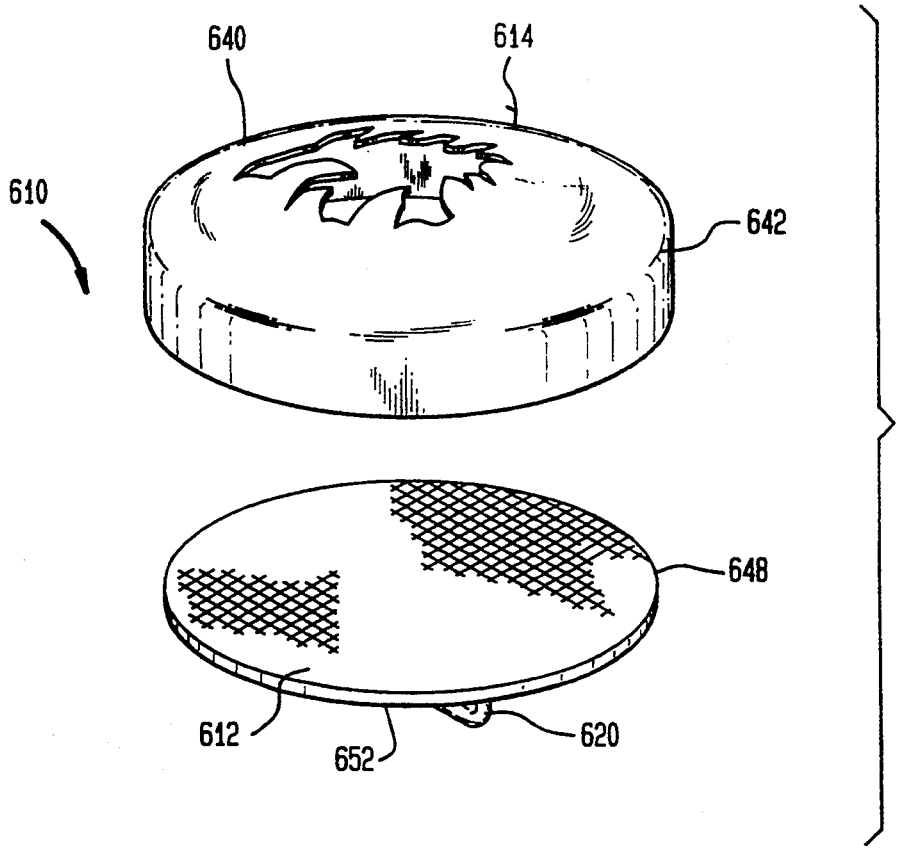
FIG. 12
FIG. 13
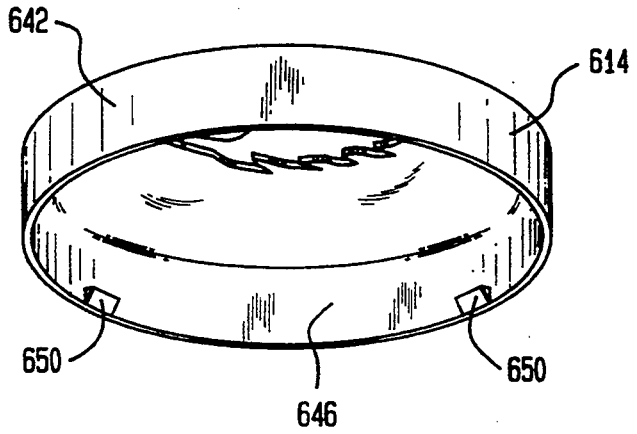
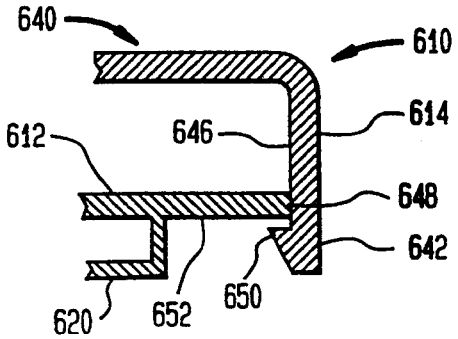
FIG. 14

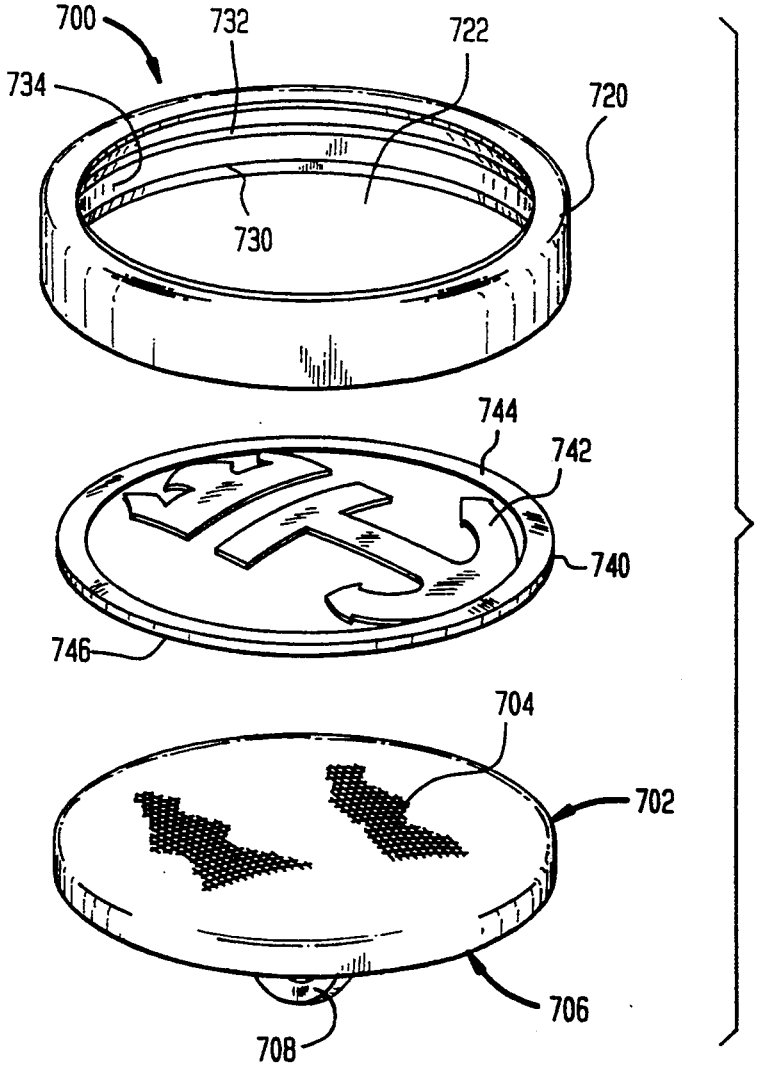
FIG. 15
FIG. 16
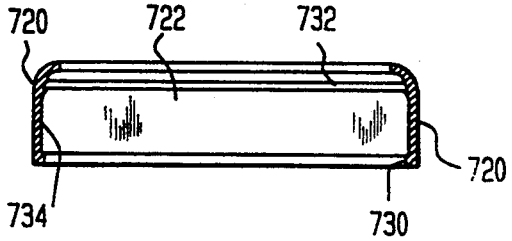
FIG. 17
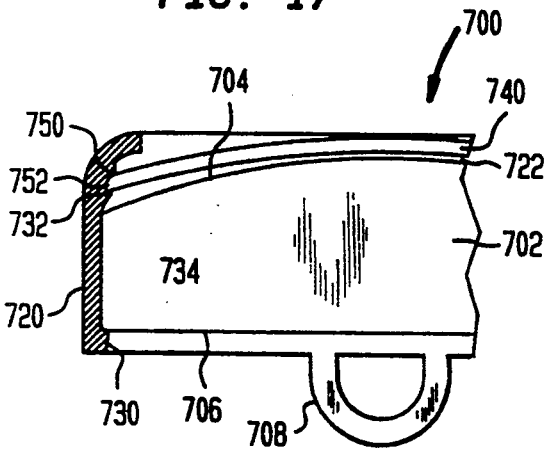

DECORATIVE MULTI-PART ORNAMENTATIONS HAVING A COLLAR ELEMENT

CROSS-REFERENCE TO RELATED APPLICATIONS

This application is a continuation-in-part of U.S. patent application Ser. No. 08/044,263, filed Apr. 7, 1993, now U.S. Pat. No. 5,315,739, which is a continuation-in-part of U.S. patent application Ser. No. 07/843,457, filed Feb. 28, 1992, now U.S. Pat. No. 5,755,417, which is a continuation-in-part of U.S. patent application Ser. No. 07/737,066, filed Jul. 29, 1991, abandoned, and a continuation-in-part of U.S. patent application Ser. No. 07/805,322, filed Dec. 10, 1991, abandoned, all of which are incorporated herein by reference.

BACKGROUND OF THE INVENTION

This invention relates to ornaments, and more particularly to multi-part ornaments, particularly in the form of buttons, jewelry, buckles and the like and the method of making them.

Ornaments, particularly in the form of buttons, buckles and items of jewelry such as broaches, pins, rings, earrings, bracelets, beads, pendants and the like are used extensively to dress-up and decorate wearing apparel and one's person. Buttons and buckles, for example, are extensively used on wearing apparel as fastening devices and for decoration. Jewelry is similarly worn and displayed for a like purpose. Buttons and jewelry are also used as fasteners and for ornaments in non-garment, non-wearing apparel applications. Accordingly, there is a great need for a large variety of shapes, sizes and configurations for such ornaments, buttons, buckles and jewelry, and for a variety of finishes for such sizes, shapes and configurations.

According to this invention, a large number of different decorative combinations is made possible by mixing and matching a fancy base member with an ornate top element and an optional intermediate insert. Such ornaments generally include a base member, a portion which is used to attach the item to a garment, for example, in use. Buttons and belts, for example, include holes, a loop or a shank through which thread, belts or other fastening material is passed to attach and secure the button or buckle to the garment, or other surface to which the button is to be attached. Jewelry pieces include pins, catches, loops, chains, clips, clasps and a myriad of other devices by which the decorative part of the jewelry item is positioned for show.

Surfaces of many buttons and buckles are plain and merely display the material from which the button or buckle is made and the particular color or colors selected. However, a considerable number of buttons, buckles and most jewelry items are finished in many ways to provide a decorative surface that may. For instance U.S. Pat. No. 3,715,781 provides for snapping a decorative member for the button in place but manufacture limits the ornamentation to one having a ridge about the decorative member where the decorative member is fabricated from springy material requiring a certain amount of dexterity to spring the decorative member and place it within its ridge.

An alternative multi-part construction is shown in U.S. Pat. No. 3,439,439 for use with coins as the decorative element and requires a clevis that is loosely positioned and held in place by the decorative element.

Other multi-part constructions are shown in U.S. Pat. Nos. 56,791; 316,253; and 327,442.

Some multi-part constructions use a base part and a decorative part that assembles to the base with a snap type detenting action such as shown in U.S. Pat. Nos. 2,087,074; 3,414,949; 3,133,331; 4,742,696; and 4,959,890. Spring like or resilient-type fastening elements for securing other type of items together are shown in U.S. Pat. Nos. 2,674,107; 2,860,395; 4,507,344; 4,793,155; 4,891,956; 4,899,556 and 4,912,829. Other multi-part constructions are shown in U.S. Pat. Nos. 2,220,038; 2,354,513; and 4,471,510.

This invention to provides an improved multi-part ornamental construction for buttons, buckles and jewelry wherein a single base member can be assembled with and have secured thereto a number of different decorative cap members by means of an intermediate collar. In the most preferred embodiment, the decorative cap members, once secured to the base member are substantially inseparable therefrom.

SUMMARY OF THE INVENTION

It is an object of this invention to provide an ornamental assembly comprising a hollow cap element having top and side walls, which side walls have inner and outer surfaces which co-terminate at an edge lip; a collar attached about the inner surface of the side walls of said cap element at the edge lip; and a base element capable of being attached to said collar by means for snapping the base element and the collar together.

The invention also provides a method of producing an ornamental assembly which comprises providing a hollow cap element having top and side walls, which side walls have inner and outer surfaces which co-terminate at an edge lip; providing a collar and attaching said collar about the inner surface of the side walls of said cap element at the edge lip; providing a base element capable of being attached to the collar by means for snapping the base element and the collar together; and snapping together the base element and the collar.

BRIEF DESCRIPTION OF THE DRAWINGS

In the drawings:

FIG 8 is another perspective view of the button cap of FIG. 8 with a manufacturing step performed thereon.

FIG. 12 is an exploded perspective view of another button cap and base assembly where the cap is partially open for viewing therethrough.

FIG. 13 is a perspective view of cap for the button assembly of FIG. 11, looking in from the bottom to better show details thereof.

FIG. 14 is a sectional view of a portion of the cover for the assembly of FIG. 12.

FIG. 15 is an exploded perspective view of an ornament in the configuration of a finger ring.

FIG. 16 is a vertical sectional view of the cover for the finger ring taken on line 16—16 of FIG. 15.

FIG. 17 is a vertical sectional view of a portion of the cover of FIGS. 15 and 16.

DETAILED DESCRIPTION OF THE PREFERRED EMBODIMENTS

Figure 1:
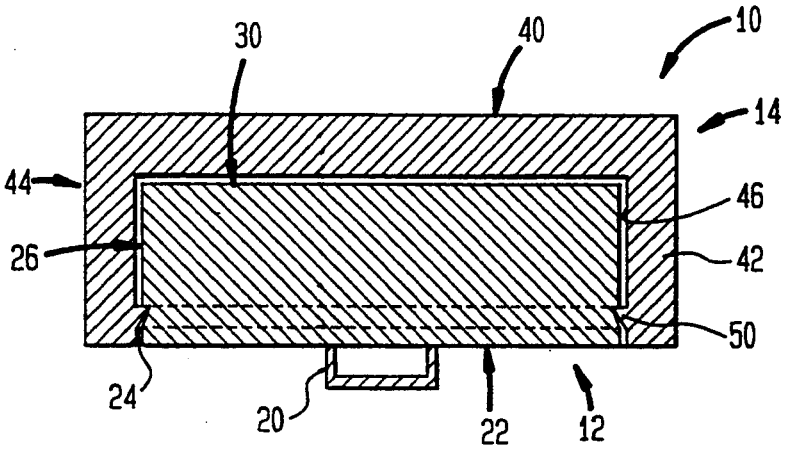
FIG. 1 is a vertical section through an item of ornamentation in the form of a button assembly showing a cap and a cooperating base.

With reference to FIG. 1 there is generally shown at 10 an item of ornamentation in the configuration of a button assembly including a button base member 12 and a button cap member 14. Button base 12 is fabricated from materials conventionally utilized to fabricate buttons such as plastic, metal, wood, bone or the like and includes an anchor or loop 20 conventionally secured to and extending from an underside 22 of button base 12. Anchor or loop 20 is of a size, configuration and disposition to receive a fastening medium such as wire, thread or the like, to facilitate fastening button assembly 10 to an article, such as clothing or the like. A groove 24 is formed in a side surface 26 of button base 12 and extends around the periphery of button base 12 at a predetermined location between underside 22 and a top 30 of button base 12. The button base 12 may be circular, oval, square or any other conventional configuration. If desired, groove 24 may be discontinuous.

Button cap member 14 includes an upper surface 40 and side wall 42 including a side surface 44 depending therefrom thus forming a cap-like member. Surfaces 40 and 44 may, if desired, be decorated with any desired motif, surface texture, color, or other aesthetic design or configuration. Side wall 42 includes an inner surface 46 having an open configuration corresponding to the circumferential configuration of side surface 26 of button base 12. An outwardly extending rib 50 extends about inner surface 46 of side wall 42 at a location thereon to co-act with groove 24 of button base 12. Rib 50 may be discontinuous or continuous and is formed discontinuous if groove 24 is so formed to correspond to and co-act with groove 24.

At least side wall 42 of button cap member 14 is formed to be resilient so that it can snap over button base 12 so that its rib 50 will snap into and co-act with groove 24 to secure button cap member 14 to button base 12. The resilience of side wall 42 and the co-action of rib 50 and groove 24 is selected to permit relatively easy assembly of button cap member 14 and button base member 12 but not permit disassembly thereof.

In a preferred embodiment of this invention, the cap and base members of the assembly are permanently and non-removably attached to one another once they are snapped together. In this case, once these parts are united, essentially the only way they can be separated again would be to physically break them apart so that they would subsequently be non-usable, i.e. not re-attachable. This is important in cases wherein consumers would find it unacceptable for an item to readily disassemble. For example, if a button on a garment comes apart either in a store, or in use, the customer would find that entire garment to be unacceptable. Hence readily detachable buttons, jewelry items and the like would be flimsy and not commercially viable. Also, customers would be of the view that detachable ornaments items might be a child swallowing hazard. In the preferred embodiment, this non-removable attachment is achieved in the absence of adhesives and with only finger pressure. The attachment is preferably conducted at room temperature and without the addition of heat. In a more preferred embodiment, the ornamentation elements are also non-rotatable with respect to one another and in the most preferred embodiment, the elements are substantially not movable with respect to one another.

The above described button assembly construction permits use of a single button base member with many different button cap members and facilitates the availability of a variety of buttons to a manufacturer of articles of clothing or the like which use such buttons, while at the same time minimizing the number of items in inventory by reducing the number of button bases for making such button assemblies. Ornament 10 of FIG. 1 may just as well be a buckle or a piece of jewelry such as a ring, broach, pin, pendant, tie tack, one of a pair of earrings or the like with cap member 14 comprising the decorative portion of the piece of jewelry and base member 12 serving as the base for the decorative portion. The size and configuration of such base member 12 and its decorative portion 14 would be selected to provide the size and configuration appropriate to the type and kind of jewelry. Anchor or loop 20 would be modified or removed and replaced by an appropriate and conventionally available attaching or carrying structure such as a finger loop for a ring, a pin with catch for a pin or broach, studs or clips for earrings, or a loop for a pendant and the like.

Figure 2:
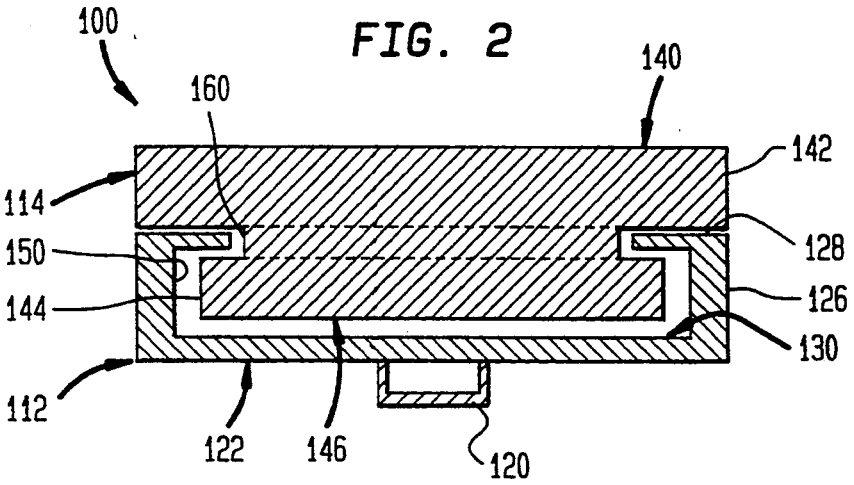
FIG. 2 is a vertical section through another button assembly.

FIG. 2 shows another embodiment of ornamentation in the configuration of a button assembly 100 including a button base member 112 and a button cap member 114 all incorporating the instant invention. Button base member 112, like button base member 12 of the FIG. 1 embodiment, is fabricated from materials conventionally utilized to fabricate buttons and includes an anchor or loop 120 suitably and conventionally secured to and extending from an underside 122 of button base member 112. Anchor or loop 120 is of a size, configuration and disposition to receive a fastening medium, such as wire, thread or the like, to facilitate attaching button assembly 100 to an article such as clothing or the like.

Button base member 112 is generally cup shaped and further includes an upwardly extending side wall 126 about its periphery terminating in an in-turned lip or rib 128 disposed at a predetermined height above a top surface 130 of button base member 112. The circumferential configuration of button base member 112, like that of button base 12 of FIG. 1, may be circular, oval, square, rectangular or any other conventional configuration. If desired lip or rib 128 may be discontinuous or may have fastening means at its tip such as a bead or a hook.

Button cap member 114 includes an upper surface 140, upper side wall 142, lower side wall 144 and a lower surface 146. Surface 140 and the surface of upper side wall 142 may, if desired, be decorated with any selected motif, surface texture, color, or other aesthetic design or configuration. The surfaces of lower side wall 144, and if desired upper side wall 142, are fabricated with a peripheral or circumferential configuration corresponding to that of side wall 126 of button base member 112; with the peripheral configuration of lower side wall 144 of reduced diameter to that of upper side wall 142 and also corresponding to the internal peripheral configuration of lip 128 and of an internal surface 150 of side wall 126 of button base 112. The height of lower side wall 144 is such that lower surface 146 of button cap 114 will not bottom against upper surface 130 of button base member 112.

A circumferential groove 160 extends around the periphery of button cap member 114 at the upper extremity of lower side wall 144 thereof proximate upper side wall 142. Groove 160 may be continuous or discontinuous and if discontinuous along with lip 128, the groove will correspond to rib 128 and co-act therewith as it will if groove 160 is continuous.

At least side wall 126 of button base member 112 is fabricated or formed to be resilient and so that its lip or rib 128 will receive and snap over lower side wall 144 of button cap 114 and into groove 160 to co-act therewith and secure button cap member 114 to button base 112 permanently.

The resilience of side wall 126 of button base member 112 and the co-action of lip 128 thereof with lower side wall 144 and groove 160 is selected to permit relatively easy assembly of button cap member 114 and button base member 112 but not permit disassembly thereof. Thus, the construction of the above described button assembly 100, like that of button assembly 10 of FIG. 1, permits use of a single button base member with many different button cap members and facilitates the availability of a variety of buttons to a manufacturer of articles such as clothing which utilizes such buttons, while at the same time minimizing the number of items of inventory the manufacturer must stock by reducing the number of button base members for making such button assemblies.

Ornament 100 of FIG. 2 may just as well be a piece of jewelry such as a ring, broach, pin, pendant, bead, tie tack, one of a pair of earrings or the like, with cap member 140 comprising the decorative portion of the piece of jewelry and with base member 120 serving as the base for the decorative portion. The size and configuration of such base member 120 and its decorative portion 140 would be selected to provide the size and configuration appropriate to the type and kind of jewelry. Anchor or loop 120 would be modified or removed and replaced by an appropriate and conventionally available attaching or carrying structure such as a finger loop for a ring, a pin with catch for a pin or broach, studs or clips for earrings, or a loop for a pendant and the like.

Figure 3:
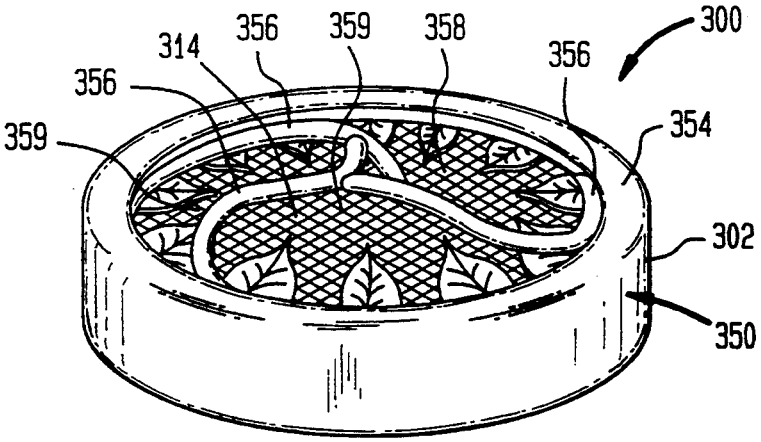
FIG. 3 is a perspective view of a button construction in the assembled state.
Figure 4:
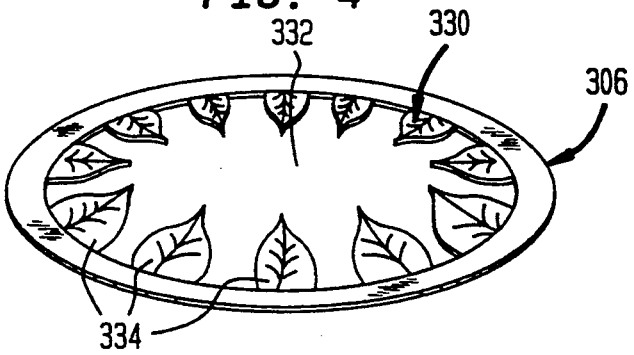
FIG. 4 is a perspective view of an decorative insert member which is positionable between the base and cap members.
Figure 5:
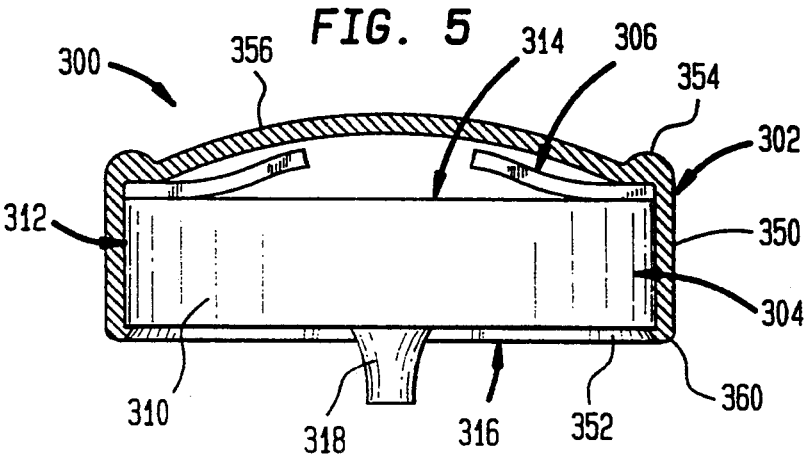
FIG. 5 is a vertical section through the assembly of FIG. 3.

FIGS. 3, 4 and 5 together show yet another embodiment of ornamentation in the configuration of a button assembly 300 incorporating the instant invention. A button cap member 302 is formed to co-act with a button base member 304 and with an intermediate button member 306 disposed therebetween as shown in FIGS. 3 and 5.

Button cap member 302, base member 304, and intermediate member 306 may be fabricated from conventional and available materials usually employed for making buttons as described for the button assemblies of FIGS. 1 and 2, with the material of button cap member 302 being resilient for purposes to be hereinafter described.

As shown in FIG. 5, base member 304 includes a disc-like body 310 having a side surface 312, an upper surface 314 and a lower surface 316 from which extends an anchor or hook 318 formed with an opening (not shown) to receive a fastening member such as a wire or thread (not shown) for purposes of securing button assembly 300 to an article of clothing or the like. At least upper surface 314 of button base member 304 may be decorated like the selected surfaces of button cap members 14 and 114 of the FIG. 1 and 2 embodiments, or if desired the entire body 310 of base member 304 may be covered by a fabric such as cloth, plastic, leather or the like.

Intermediate member 306 is disc-like in that its peripheral configuration conforms to that of button base member 304 and button cap member 302. Intermediate member 306 may be formed of relatively thin material dished upwardly as shown in FIGS. 4 and 5 and with a selected design 330 cut therein and therethrough to form an opening 332 and, if the design so employs, a number of leaf-like elements 334 disposed thereabout. Opening 332 may be centrally and systematically located with leaf-like elements 334 disposed symmetrically thereabout or they may be non-symmetrically disposed and not centered, as desired. Preferably there is an opening through intermediate member 306 through which upper surface 314 of button base member 302 can be seen. Intermediate member 306 also need not be dished as shown but may be just a relatively flat member.

Button cap member 302 preferably includes a ring-like side wall 350 having a lower opening 352 (FIG. 5) at its bottom, a circumferential rib 354 (FIGS. 3 and 5) around its top edge, and a plurality of lace-like strips 356 spanning an upper opening 358 dividing it into a plurality of smaller openings 359. A bead-like rib or hook 360 (FIG. 5) extends about the circumferential periphery of lower opening 352 for co-action with button base member 304 as will be hereinafter described. The height of side wall 350 is selected so that bead 360 thereof will snap beneath lower surface 316 of button base member 304, when base member 304 is disposed within cap member 302 and when intermediate member 306 is disposed on upper surface 314 of base member 302 as shown in FIG. 5 and co-act with lower surface 316 of base member 304 and side wall 312 thereof to secure button cap member 302 and intermediate member 306 together with button base member 304 to form button assembly 300. The resilience of at least side wall 350 of button cap member 302 permits a relatively easy snapping of cap member 302 over base member 304 and intermediate member 306 and thus assembly of button 300, but does not permit disassembly thereof.

Leaf-like ribs 356 may be of any desired thickness, configuration, disposition and number and need not necessarily completely span upper opening 358. Preferable there are sufficient smaller openings 359 to view intermediate member 306 and button base member 302. Button assembly 300 thus permits use of a single button base member with many different intermediate and cap members to facilitate the availability of a large variety of buttons as described for the button assemblies of the FIGS. 1 and 2 embodiments. Ornamentation 300 of the embodiment of FIGS. 3–5 may just as well be a piece of jewelry such as a ring, broach, pin, pendant, bead, tie tack, one of a pair of earrings or the like with cap member 302 and intermediate member 306 comprising the decorative portions of the piece of jewelry and with base member 304 serving as the base for the decorative portions. The size and configuration of such base member 304 and its decorative portions 302, 306 would be selected to provide the size and configuration appropriate to the type and kind of jewelry. Anchor or loop 318 would be modified or removed and replaced by an appropriate and conventionally available attaching or carrying structure such as a finger loop for a ring, a pin with catch for a pin or broach, studs or clips for earrings, or a loop for a pendant and the like.

Figure 6:
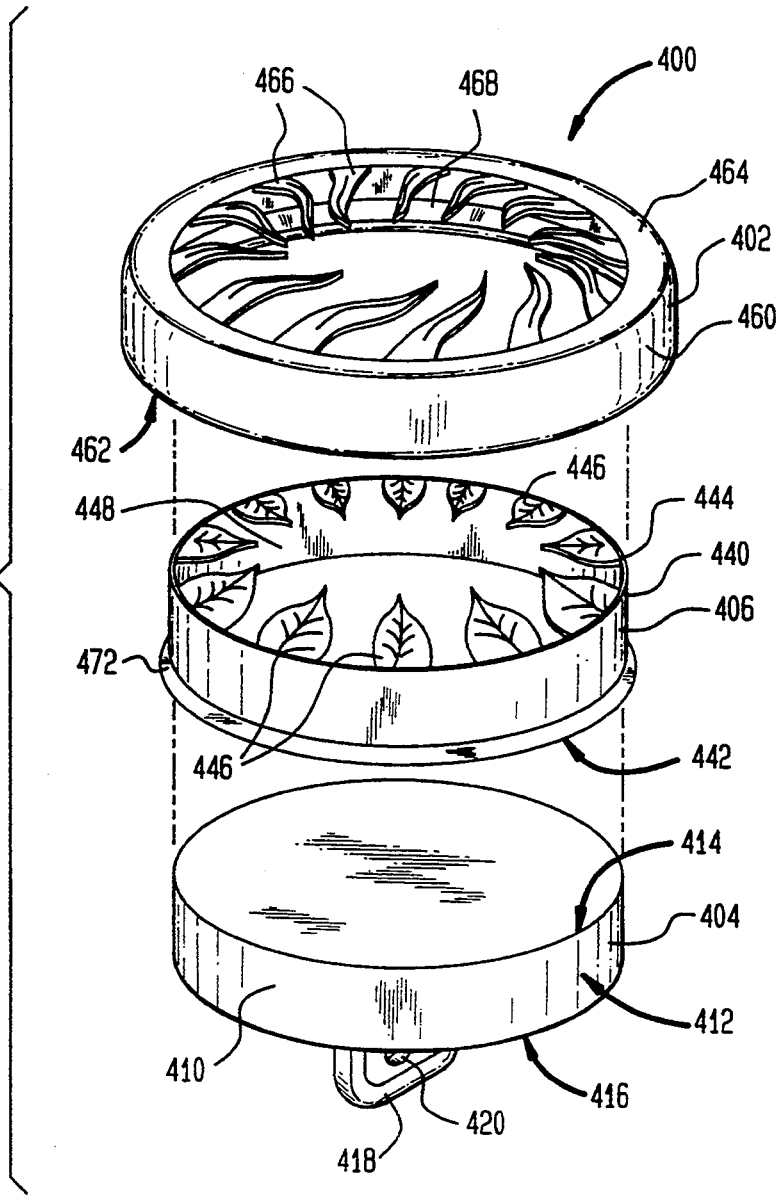
FIG. 6 is an exploded perspective view of another button assembly showing a cap, insert and base.
Figure 7:
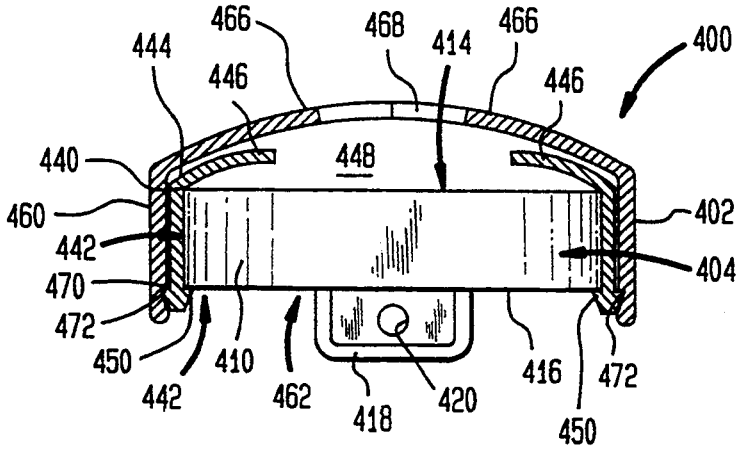
FIG. 7 is a vertical section of the button assembly of FIG. 6.

FIGS. 6 and 7 together show another embodiment of ornamentation in the configuration of a button assembly 400 incorporating the instant invention. A button top-cap member 402 is formed to co-act with a button base member 404 with a button intermediate-cap member 406 disposed therebetween. Top-cap member 402, base member 404 and intermediate-cap member 406 may be fabricated from conventional and available materials usually employed for making buttons as described for the other above described button assemblies, with the materials of button top-cap member 402 and intermediate-cap member 406 being resilient for purposes to be hereinafter described.

Button base member 404 includes a disc-like body 410 having a side surface 412, an upper surface 414 and a lower surface 416 from which extends an anchor or hook 418 formed with an opening 420 to receive a fastening member such as a wire or thread (not shown) for purposes of securing button assembly 400 to an article of clothing or the like. Upper surface 414 of button base member 404 may be decorated like that of button base member 314 of button assembly 300 (FIGS. 3–5) or like button base member 304, button base member 404 may be covered by fabric such as cloth, plastic, leather or the like.

Button top-cap member 402 and button intermediate-cap member 406 are each cup-like and similar in configuration except that intermediate-cap member 406 is of a size and configuration to snap over and non-removably co-act with button base member 404 and top-cap member 402 is of a size and configuration to snap over and non-removably co-act with both intermediate-cap member 406 and button base member 404.

Button intermediate-cap member 406 may include a ring-like side wall 440 having a lower opening 442 (FIG. 7) at its bottom, a circumferential rib 444 around its top edge and a plurality of leaf-like cut-out members 446 extending into an upper opening 448. A bead-like rib 450 (FIG. 7) extends about the circumferential periphery of lower opening 448 for co-action with button base member 404 as will be hereinafter described. The height of side wall 440 is selected so that bead 450 thereof will snap beneath lower surface 416 of button base member 404, when button base member 404 is disposed within intermediate-cap member 406 as shown in FIG. 7, and will co-act with lower surface 416 and side wall 412 of button base member 404 to secure intermediate-cap member 406 in place permanently.

Top-cap member 402, like intermediate-cap member 406, includes a ring-like side wall 460 having a lower opening 462 (FIG. 7) at its bottom, a circumferential rib 464 around its top-edge and a plurality of leaf-like cutout members 466 extending into an upper opening 468. A groove 470 extends about the circumferential periphery of an inner surface of top-cap 402 proximate lower opening 448 for co-action with intermediate-cap member 406 and button base member 404 as will be hereinafter described. The height of side wall 460 is selected so that groove 470 thereof will snap onto an outer bead 472 proximate a lower edge of side wall 440 of intermediate-cap member 406, as shown in FIG. 7, when top-cap member 402 is disposed over intermediate-cap member 406 and will co-act with same to secure top-cap member 402 in place permanently.

Leaf-like members 446 of intermediate-cap member 406 and 466 of top-cap member 402 may be of any desired thickness, configuration, disposition, and number and need not necessarily completely span their respective upper openings as long as there is sufficient open space through the tops of the cap members to view the intermediate-cap member leaf-like members through top-cap member 402 and to view button base member 404 through both cap members. If desired, the leaf-like members 446, 466 of either or both cap members may be replaced by cross-ribs as utilized for top member 302 of FIG. 3.

Figure 8:
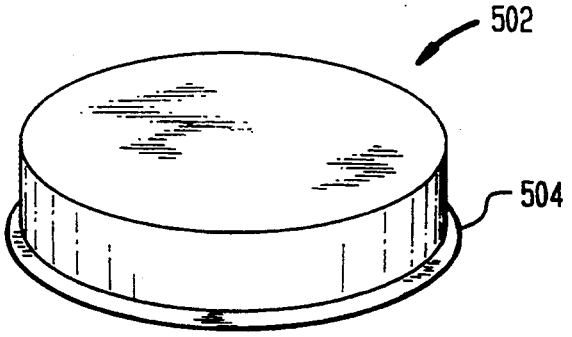
FIG. 8 is a perspective view of an item of ornamentation in the configuration of a button cap.
Figure 9:
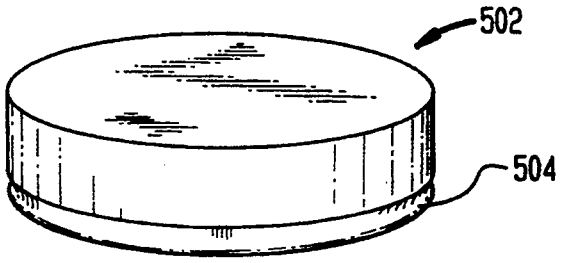
Figure 10:
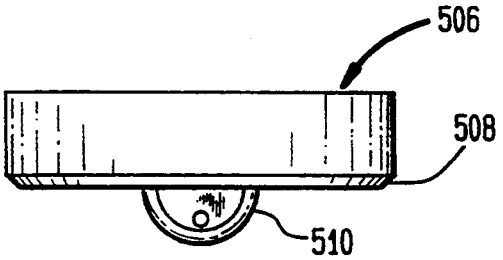
FIG. 10 is a side view of a button base for the button cap of FIGS. 8 and 9.

FIGS. 8–10 shows yet another embodiment in the configuration of a button cap 502. Cap 502 may be made, for example, of metal, such as brass or aluminum. Fitted along a free marginal edge of cap 502 may be a grommet or collar 504. Collar 504 may be made of any suitable material, such as rubber or plastic. Collar 504 may be substantially ring-shaped and may have a slit cut circumferentially (not shown) to admit the marginal edge of the cap 502. In the next step, the edge of the cap 502 is bent inwardly as in FIG. 9. A button base 506 is of a similar construction to those disclosed hereinabove. A chamfer 508 (FIG. 10) is formed at the lower or bottom portion of base 506. On assembly, cap 502 is forced over base 506 and collar 504 snapped into chamfer 508 locking cap 502 into position.

Figure 11:
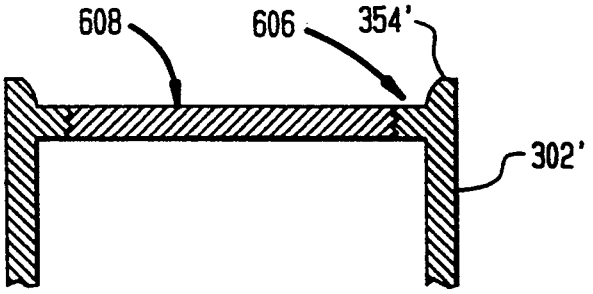
FIG. 11 is a sectioned view of another button cap useful for the invention.

Ornamentation 502 of the embodiment of FIGS. 8–10 may just as well be a piece of jewelry such as a ring, broach, pin, pendant, bead, tie tack, one of a pair of earrings or the like with cap member 502 comprising the decorative portion of the piece of jewelry and with base member 506 serving as the base for the decorative portions. It will also be understood that the cap (e.g., the cap of FIG. 4 or 6) may have a central portion internally threaded. Thus, as shown in FIG. 11, a cap 302' may have a threaded opening 606 formed in its top wall adjacent to its circumferential portion 354'. A design-bearing top wall 608 may then be threaded into the top. Once threaded into position, the consumer will not be aware that the design is inserted into the button. This assembly enables the manufacturer to employ any of a multiplicity of design elements to be used with a single shaped cap and base. It is understood that any of the base members (e.g. 12, 112, 304, 404) can also be a sew-through base member, without the shank construction, as is well known in the art.

While the various ribs 50, 128, 360, 450 and 472 of the respective embodiments of FIGS. 1, 2, 3–5 and 6–7 respectively have been shown as being continuous about the circumference of their respective members, they may just as well be discontinuous as long as there is sufficient rib to co-act with the respective grooves or base members to provide the desired and required secure attachment of caps and bases.

Figure 12A:
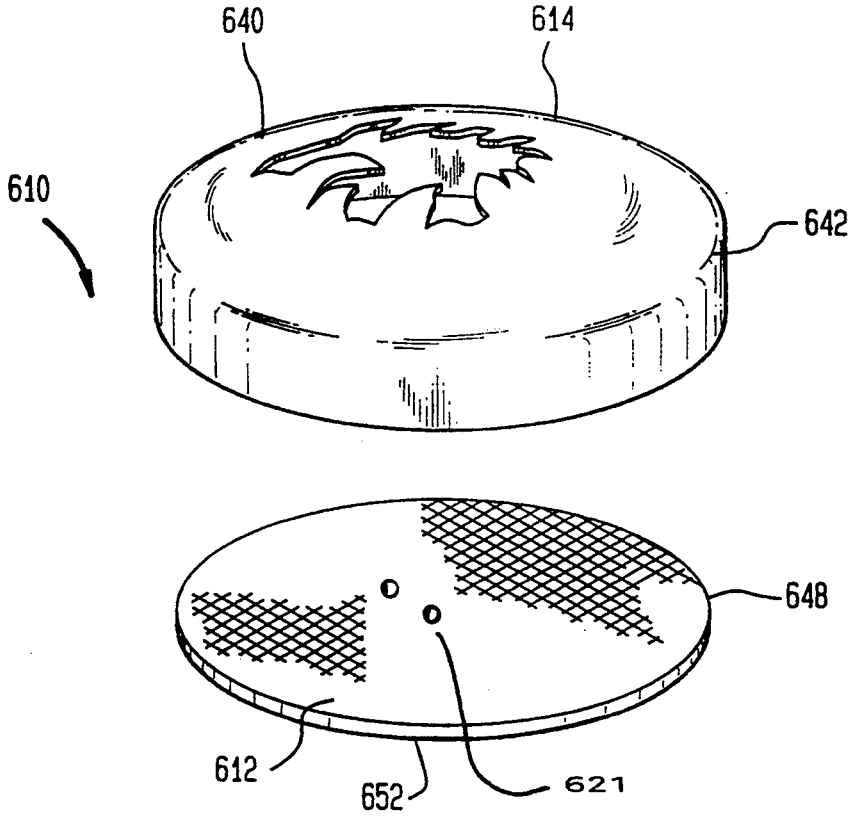
FIG. 12A is an exploded perspective view of a sew through button assembly according to this invention.

With reference to FIGS. 12–14 there is generally shown at 610 a button assembly including a button base member 612 and a button cap member 614. Button base 612 is fabricated from materials conventionally utilized to fabricate buttons such as plastic, metal, wood, bone or the like and includes an anchor or loop 620 suitably and conventionally secured to and extending from an underside 652 of button base 612. Anchor or loop 620 is of a size, configuration and disposition to receive a fastening medium such as wire, thread or the like, to facilitate fastening button assembly 610 to an article such as clothing or the like. FIG. 12A shows a button similar to FIG. 12, however sew through holes 621 are provided instead of loop 620.

Button cap member 614 includes an upper surface 640 and side wall 642 depending therefrom thus forming a cap-like member. Surfaces 640 may, if desired, be decorated with any desired aesthetic design. As shown in FIGS. 12 and 12A, in one preferred embodiment of the invention, surface 640 is not continuous, but rather has one or more see through openings in any desired design. This allows the button base member or any optional intermediate members to be seen through the surface. Side wall 642 includes an inner surface 646 (FIGS. 13 and 14) having an open configuration corresponding to the circumferential configuration of side surface 648 (FIGS. 12 and 14) of button base 612. A plurality of inwardly extending ribs or latching elements 650 extend about inner surface 646 of side wall 642 at locations thereon to co-act with bottom surface 652 of button base 612. Latching elements 650 are formed discontinuous and spaced about inner surface 646 and so as to correspond to and co-act with bottom surface 652 of button base 612 for permanent attachment. Side wall 642 of button cap member 614 is formed to be resilient and so that it can snap over button base 612 so that latching elements will snap beneath and co-act with bottom surface 652 of button base 612. The resilience of side wall 642 and the co-action of latching elements 650 with button base 652 is selected to permit relatively easy assembly of button cap member 614 and button base member 612 but not to permit disassembly thereof.

FIGS. 15, 16 and 17 together show yet another ornament in the configuration of a piece of jewelry such as a finger ring 700 incorporating the instant invention. Ring 700 includes a base or body member 702 formed of suitable and appropriate ring material such as metal (gold, silver, etc.) plastic, wood or the like and having an upper surface 704 which may or may not be decorated and a lower surface 706 to which is secured a finger loop 708 suitably and appropriately sized. A snap cover 720 is formed cap-like and of suitable metal, plastic or other materials and of a size and configuration to receive base body 702 within an inside space 722. A pair of substantially parallel and spaced latching rings or ribs 730, 732 are formed within and extending from an inner surface 734 of cover 720. The lower ring or rib 730 is configured and disposed to co-act with a lower surface of base 702 to retain base 702 and cover 720 positioned one with respect to the other. An insert 740 is formed of suitable material such as metal, plastic or the like to provide a decorative effect when disposed between snap cover 720 and base 702 as shown in FIG. 17. Insert 740 may be solid, or cut-out to form a design 742 (FIG. 15) disposed within a circumferential ring 744. Insert 740 is sized and configured to be snapped in place within space 722 of cover 720 and to be secured in position by co-action of ring 744 of insert 740 with latch ring or rib 732 as shown in FIG. 17. If desired, ring or rib 732 may be formed to co-act with and be spaced from an upper ridge 750 to define with rib 732 a circumferential groove 752 sized and configured to receive and secure in position circumferential ring 744 of insert 740. This construction will permit a pre-assembly of selected inserts 740 and snap covers 720 as a sub-assembly for later combination with base 702. Latch rings or ribs 730, 732 may be formed continuous as described or as discrete and discontinuous spaced members disposed about and extending from inner surface 734 of snap cover 720.

Ornamentation 700, thus, permits use of a single base member 702 with many different inserts 740 and snap rings 720 to facilitate the availability of a relatively large variety of rings or other pieces of jewelry. For that matter, base 702 may be a button base as described above for the button assembly embodiments; in that form of construction insert 740 and snap cover 720 would be constructed and utilized in manners similar to the cap members and intermediate members of the button assembly constructions of FIGS. 3–5 and 6–7.

The assembly of FIGS. 15–17 shows a base 702, a cover 720 and a single insert 740 which engages the inside of the cap. It is contemplated that one can provide several levels of similar inserts, each partially overlapping one another inside of the cap 720 in a multi-level arrangement.

Figure 18:
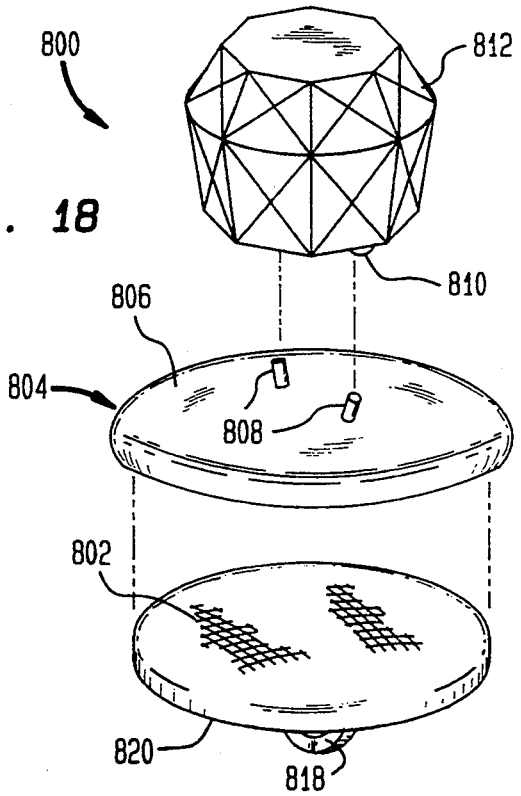
FIG. 18 is an exploded view of a pin or broach incorporating the instant invention.

FIG. 18 shows yet another embodiment of ornamentation in the configuration of a pin or broach 800. A base member 802 is formed of relatively plain and conventional material and into a configuration and size to receive and carry a cover member 804 of a size and configuration to be received by and non-removably snap onto base member 802 in a manner substantially identical to the co-action between the base and cap members of previously described embodiments. Cover member 804 is formed from cloth covered or otherwise decorated and aesthetically pleasing ornamented material and so as receive on its surface 806 a first half 808 of fastening means such as a conventional fastener the other half 810 of which is carried by yet another element of ornamentation 812. Ornamentation 812 is smaller than snap type cover member 804 and fastener halves 808, 810 are preferably disposed to position ornamentation element 812 so as to be centered on cover member 804. A non-centered disposition for ornamentation element 812 on cover member 804 may also be selected. A conventional pin or clasp 818 is fixedly secured to a rear surface 820 of base member 802.

Figure 19:
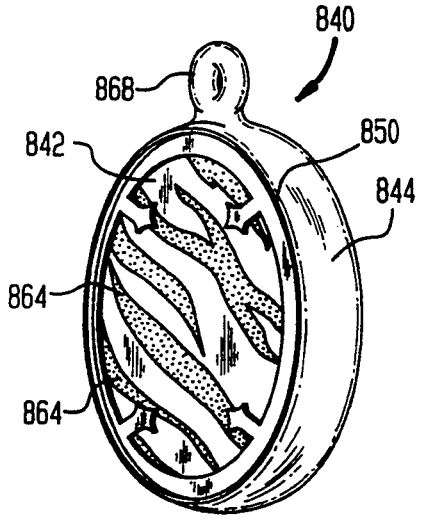
FIG. 19 is a perspective view of a pendant incorporating the instant invention.
Figure 20:
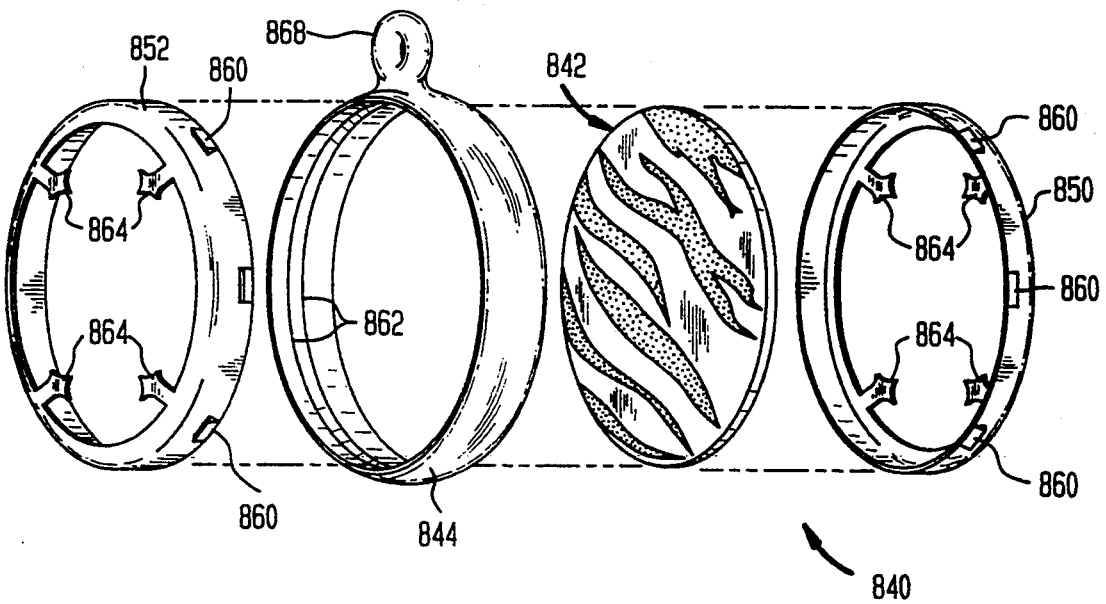
FIG. 20 is and exploded perspective view of the pendant of FIG. 19.

FIGS. 19 and 20 together show another ornament in the configuration of a pendant 840 incorporating the instant invention. An ornamentation element 842 in the configuration of a gem, semi-precious gem, stone, metal, metallic design, plastic bauble or similar aesthetically pleasing piece of costume or other jewelry type ornamentation is disposed within an outer cover 844 in the configuration of a ring. A pair of snap-in retainers 850, 852 (FIG. 20) are of a size and configuration to co-act with outer cover 844 and ornamentation element 842 to retain ornamentation element 842 in position within outer cover 844. Each snap-in retainer 850, 852 is provided with a number of latching elements 860 that co-act with a ridge-like circumferential lip 862 within outer cover to permanently seat and snap retainers 850, 852 and outer cover 844 together with ornamentation element 842 disposed therebetween as shown in FIG. 19. If preferred, latching elements 860 may be formed together as a continuous ring about the circumference of retainers 850, 852. A plurality of fingers 864 of selected configuration extend from each retainer 850, 852 to positions in front of ornamentation element 842 to further hold element 842 in position within cover 844 and retainers 860. A loop 868 of conventional construction extends out from cover 844 to facilitate hanging ornamentation 840 from a chain, rope, string or the like.

Figure 21:
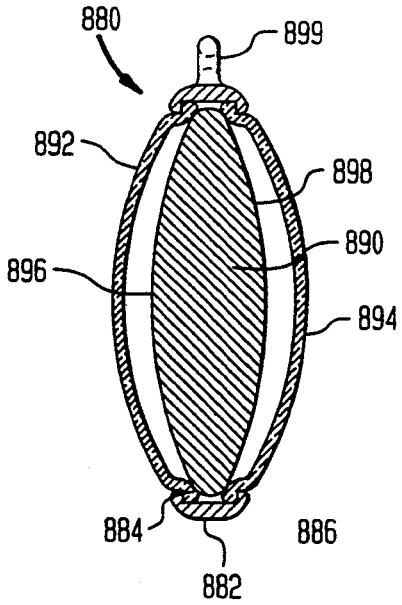
FIG. 21 is a vertical section through a further ornament in the configuration of a pendant.

FIG. 21 shows another ornament in the configuration of another pendant 880 including an outer cover or ring 882 formed with circumferential lips 884, 886 and within which is disposed an ornamentation piece 890 which may be similar to ornamentation piece 842 of FIGS. 19 and 20 and similarly held in place. A front applique 892 and a rear applique 894 are disposed respectively on opposite sides 896, 898 respectively of ornamentation piece 890 and along with piece 890 are secured in position by lips 884, 886. The circumferential configuration of piece 890 and of appliques 892, 894 may be as desired and the decoration or configuration of appliques 892, 894 may also be as desired and either identical or different. A loop 899 of conventional construction is carried by ring 882 to facilitate hanging ornamentation 880 from a chain, cord, rope, or the like.

Figure 22:
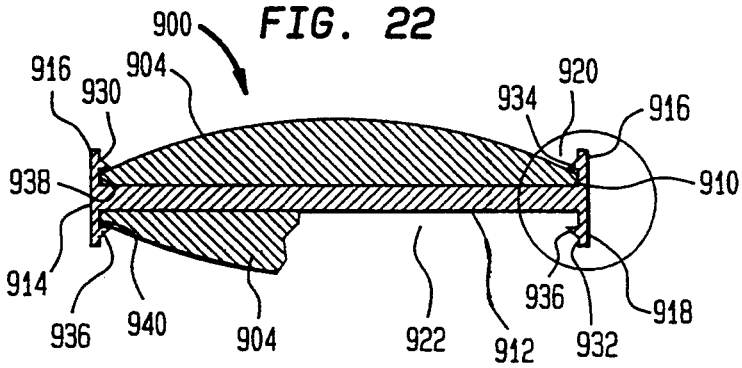
FIG. 22 is a vertical section of an item of ornamentation in the form of a pendant.
Figure 23:
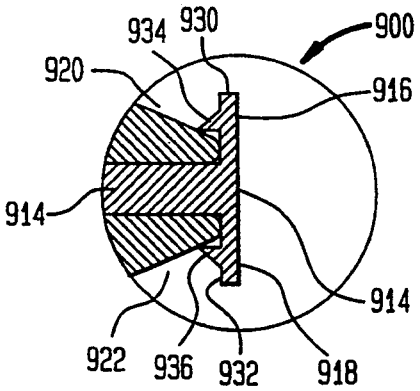
FIG. 23 is a detail of the circled portion of the pendant of FIG. 22 enlarged to better show details thereof.
Figure 24:
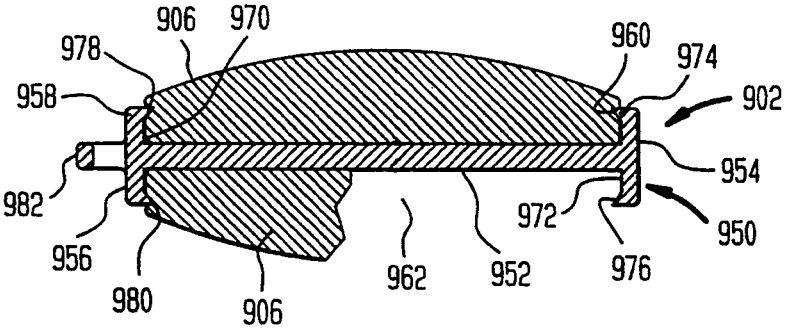
FIG. 24 is a vertical section of an alternative construction for retaining the decorative portion of the pendant of FIGS. 22 and 23 in position on its base.

FIGS. 22, 23 and 24 show pendants 900 (FIGS. 22 and 23) and 902 (FIG. 24). Each pendant 900, 902 mounts a pair of ornamentation pieces 904, 906 respectively which may be jewel or gem pieces such as cabochons or the like, pieces of semi-precious stones or of decorated or decorative metal, plastic, wood, ceramic or the like. The configuration, circumference, thickness, size specific material and its decorative finish are as may be selected by the skilled artisan.

A base member 910 is provided for pendant 900 and includes a rear wall 912 and a circumferential wall 914 with a first portion 916 extending in a first direction from rear wall 912 and a second portion 918 extending in a second direction from rear wall 918. Rear wall 918 is preferably centered with respect to circumferential wall 914 but may be otherwise disposed with respect to same as long as two spaces 920 and 922 are provided each of a size and configuration to receive a respective ornamentation piece 904.

Inner surfaces 930, 932 of circumferential wall 914 are each respectively formed with a circumferential rib 934, 936 disposed to snap over circumferential edges 938, 940 of ornamentation pieces 904 to hold and retain ornamentation pieces 904 in position within spaces 920, 922. If preferred ribs 934, 936 may e discontinuous or replaced by spaced latching members similar to those shown in the embodiment of FIG. 12. A conventional loop 940 is provided for pendant 900 to facilitate hanging pendant 900 from a chain, wire, rope, string, shoelace, or the like.

Pendant 902 also includes a base member 950 similar to base member 910 of pendant 900 in that it includes a rear wall 952 and a circumferential wall 954 providing a first portion 956 and a second portion 958 within which rear wall may be centered as shown in FIG. 24 or otherwise disposed. A first ornamentation space 960 is defined between first portion 956 and one surface of rear wall 952 and a second ornamentation space 962 is defined between second portion 958 and the other surface of rear wall 952. Spaces 960, 962 are each of a size and configuration to receive a respective ornamentation piece 906.

Inner surfaces 970, 972 of circumferential wall 954 are each respectively formed with a circumferential rib 974, 976 disposed to snap into and co-act with circumferential grooves 978, 980 respectively of ornamentation pieces 906 to hold and retain ornamentation pieces in position within spaces 960, 962. If preferred ribs 974, 976 may be discontinuous or replaced by spaced latching members such similar to those shown in the embodiment of FIG. 12. A conventional loop 982 is provided for pendant 902 similar to loop 940 of pendant 900. Base members 910, 950 may be fabricated from metal, plastic or other suitable material and with sufficient resilience for their respective circumferential walls, 914, 954 to facilitate disposition of their respective ribs for coaction with their respective ornamentation pieces.

When reference is made in this application to jewelry it is meant that jewelry like materials such as gold, silver or combinations thereof are used alone, and/or in combination with other jewelry materials such as glass, beads, semi-precious and precious stones and the like and that the surfaces of the materials, whether they be precious metals or wood, ceramic, plastic, glass or the like may be artistically decorated or not; thus encompassing all the various types of materials and finishes utilized in jewelry.

Figure 25:
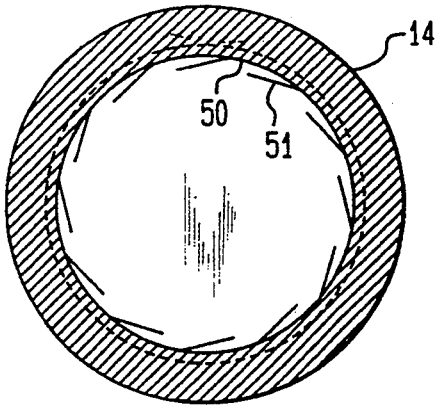
FIG. 25 shows a bottom cross-sectional view of an embodiment of the cap previously described in FIG. 1 showing catches which prevent cap rotation.

As heretofore described, the cap and base members, or combination cap and base with intermediate members are constructed in such a fashion that they are preferably not removable from each other once assembled. Referring once again to FIG. 1 as one embodiment of this feature, once cap 14 is pressed onto base 12, rib 50 slips into groove 24. Rib 50 and groove 24 are fashioned so that they are not separable from one another. In one embodiment, the lower edge of rib 50 may be rounded but the top edge may be flat so that it will not slip in an upward direction out of groove 24. Alternatively, rib 50 may hook into groove 24 or into a channel within groove 24. In another preferred embodiment, the groove of the base member, or the cap member as the case may be, may be provided with a series of stop catches to prevent rotation of the cap with respect to the base. FIG. 25 shows a bottom cross-sectional view of another embodiment of the cap 14 previously described in FIG. 1. The cross section is made through rib 50 which is provided with a series of fan-like projections 51 which catch the inside of groove 24 and prevent rotation.

Figure 26:
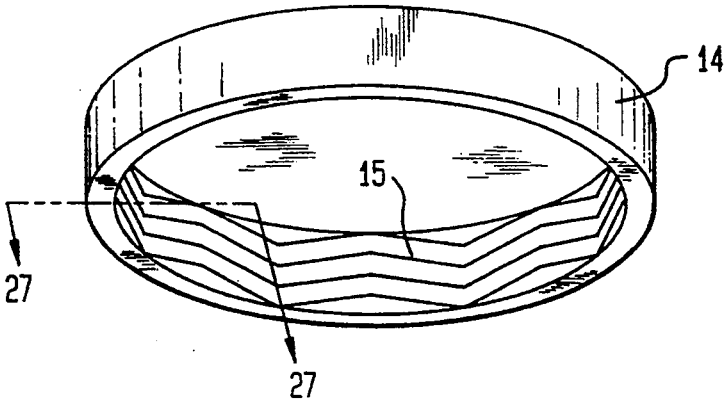
FIG. 26 shows a perspective view of an embodiment of the invention where the cap member is provided with chevron shaped catches for cooperation with a base member.
Figure 27:
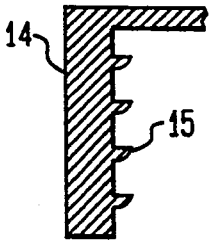
FIG. 27 shows a cross-sectional view of the cap member of FIG. 26.
Figure 28:
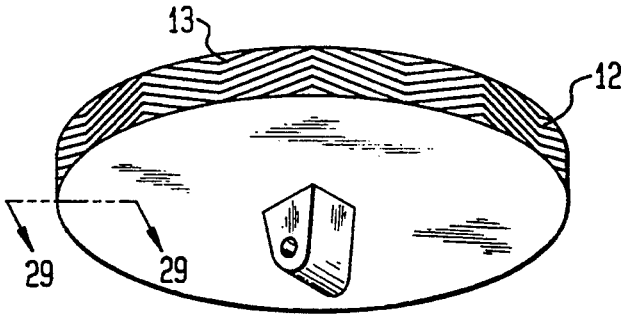
FIG. 28 shows a perspective view of an embodiment of the invention where the base member is provided with chevron shaped catches for cooperation with a cap member.
Figure 29:
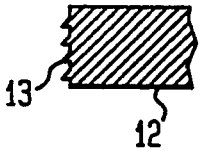
FIG. 29 shows a cross-sectional view of the base member of FIG. 28.

FIGS. 26–29 show another embodiment of the invention where cap member 14 and base member 12 are provided with complementary chevron member 13 and 15 respectively. Cap member 14 is provided with several V-shaped recesses which snap together with V-shaped raised portions 13 on the base member. Alternatively, the V-shaped raised portions can be on the inside of the cap member 14 and the recesses can be disposed on base 12. When the cap and base of FIGS. 26 and 28 are snapped together in a manner analogous to that of FIG. 1, the complementary chevrons engage and the cap and base are non-removably, non-rotatably and non-movably attached. FIGS. 27 and 29 show cross-sectional views along lines 27—27 and 29—29 respectively of the chevron configured members of FIG. 26 and 28.

Figure 30:
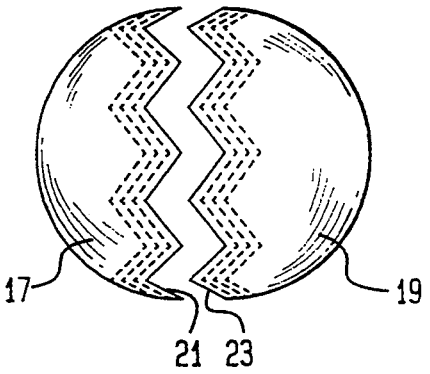
FIG. 30 shows a break-away perspective view of an embodiment of the invention where base and cap members are configured as a bead having internal complementary, raised and recessed chevron engagements.
Figure 31:
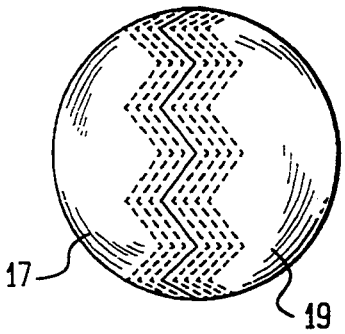
FIG. 31 shows a perspective view of the engaged bead of FIG. 30.
Figure 32:
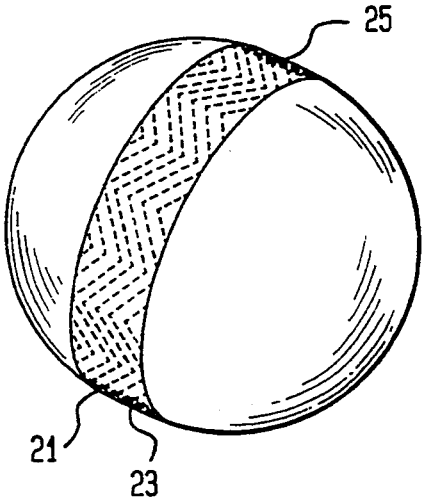
FIG. 32 shows a perspective view of the engaged bead of FIG. 30 with an additional ornamental band.

FIG. 30 shows another embodiment of the invention where a base member 17 and a cap member 19 are configured as a bead having complementary raised and recessed chevron engagement portions 21 and 23. FIG. 31 shows an outer view of such a bead when attached. FIG. 32 shows another attached bead having an ornamental band 25 and internal mating chevrons 21 and 23.

Figure 33:
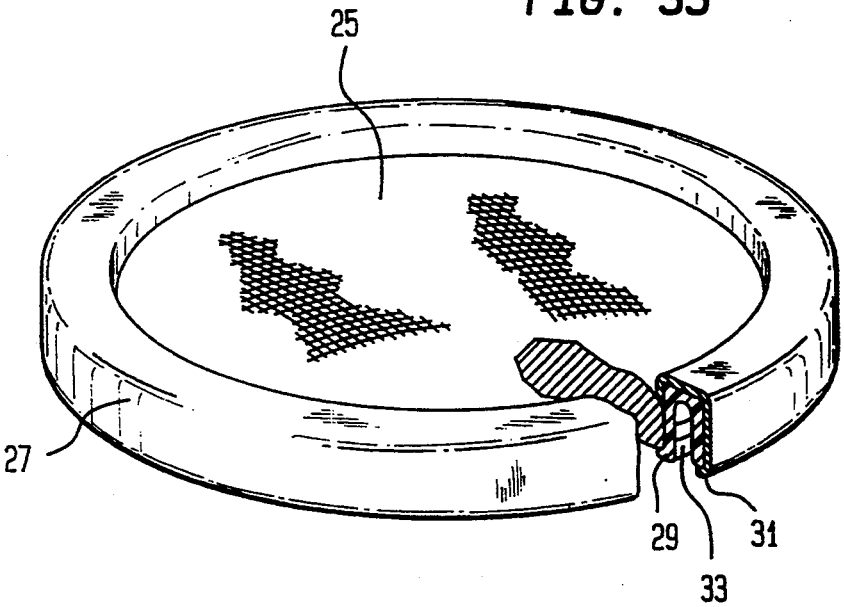
FIG. 33 shows a perspective view of another embodiment of a cap member.

FIG. 33 shows another embodiment of the invention wherein a cap member 25 is provided with a circumferential metal ring 27 around its outer periphery. Inside the ring is a plastic retainer 29. The retainer is held in place by edge 31 of the metal ring. Inside of the retainer 29 is annular channel 33 which has either groove or rib means as previously described for cooperation with the complementary base means. Similarly, this ring and retainer could be provided on the base means for cooperation and engagement with complementary cap means.

Figure 34:
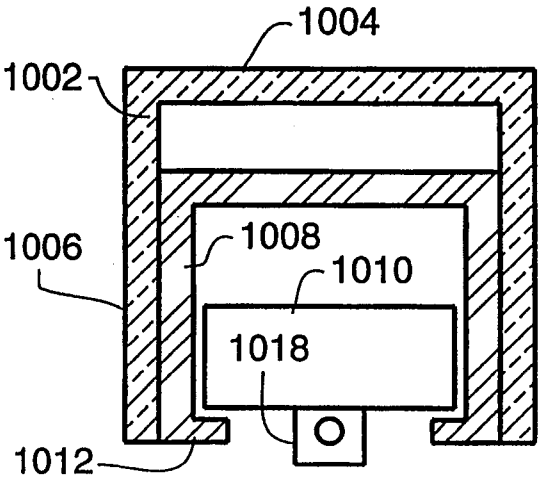
FIG. 34 Is a side sectional view of an embodiment of the invention including a cap element, collar, snapped in base element.
Figure 35:
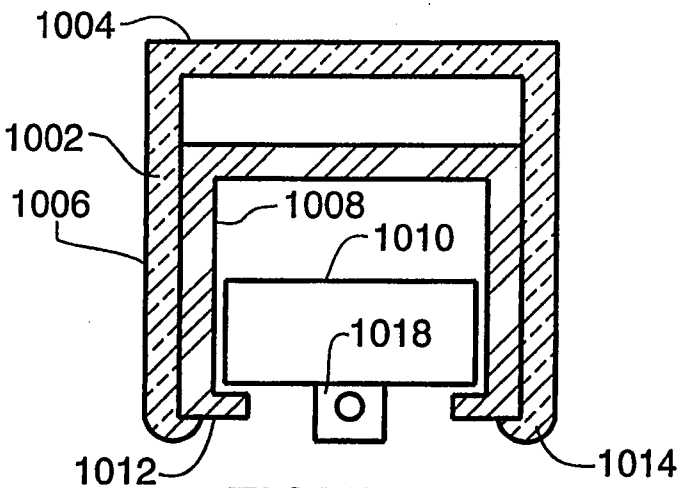
FIG. 35 shows a side sectional view with attachment of the cap by crimping the edge lip of the cap element around the collar.
Figure 36:
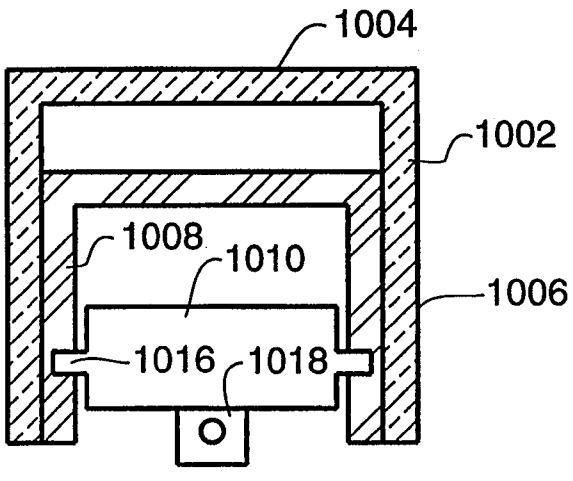
FIG. 36 shows a side sectional view with means for snapping the base to the collar by protrusions extending outwardly from the base.
Figure 37:
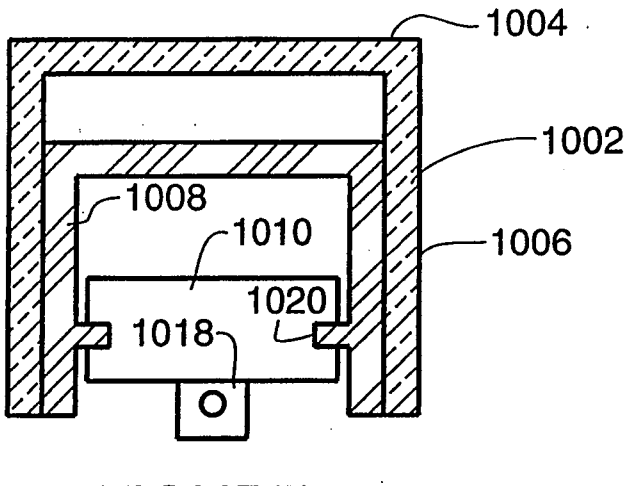
FIG. 37 shows a side sectional view with means for snapping the base to the collar by protrusions extending outwardly from the collar.
Figure 38:
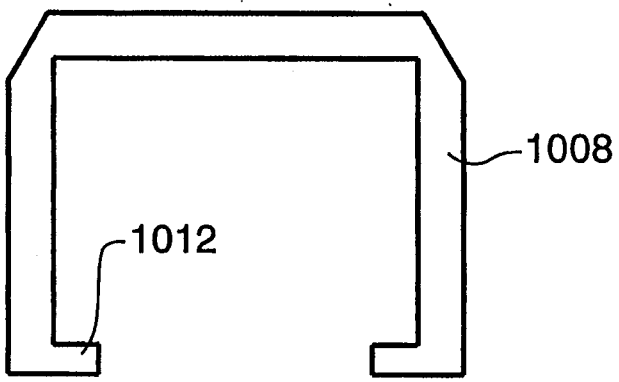
FIG. 38 shows a side view of a collar and protrusions means for snapping the base element and collar together. An optional beveled edge is also shown.

A most preferred embodiment of the invention is shown in FIG. 34. It comprises a hollow cap element 1002 having a top wall 1004 and side walls 1006. The side walls have inner and outer surfaces which co-terminate at an edge lip. A collar 1008 is attached about the inner surface of the side walls of the cap element at the edge lip. A base element 1010 is capable of being attached to the collar 1008 by means for snapping the base element and the collar together. The means for snapping the base element and collar together may be a protrusion such as part 1012 as shown in FIG. 34. The base is physically pressed into the collar into the shown position. Protrusion 1012 is constructed of a resilient, preferably plastic material which engages the underside of base 1010. The base may be either removable or non-removably attached to the collar by the snapping action, however, in the most preferred embodiment, it is non-removably affixed. In the preferred embodiment, the cap element 1002 may be composed of such materials as plastics or metals, however metals such as aluminum, brass, copper, and precious metals are preferred. The collar and the base are preferably composed of plastic, metal, wood, bone or the like. The collar may be either removable or non-removably attached to the cap, however, in the most preferred embodiment, it is non-removably affixed. The collar may be attached to the cap by a such means as a friction fit, crimping the edge lip of the cap element around the collar; an intermediate adhesive; and a heat sealing. The most preferred attachment is by spraying an adhesive at the interface of the collar and the cap. FIG. 35 shows attachment of the cap by crimping the edge lip of the cap element around the collar at 1014. FIG. 36 shows another mechanism for snapping the base 1010 to collar 1008 wherein the base has one or more protrusions 1015 extending outwardly from its sides. The protrusion can be a single rib around the circumference of the base, a series of parallel ribs (not shown) or a series of discontinuous protrusions. The protrusions preferably cooperate with and engage one or more complementary grooves on the inside wall of the collar as seen in FIG. 36. In the embodiment of FIG. 37, the aforementioned protrusions extend from the inside wall of the collar at 1020 and the grooves are on the base element. In each of FIGS. 34–36, the base member is in the form of a button having a shank 1018 for sewing the assemblage to a garment. FIG. 38 shows a side view of a collar 1008 and means for snapping the base element and collar together is embodied as a protrusion 1012. This view also shows an optional beveled edge on the end of the collar opposite to the protrusion.

Figure 39:
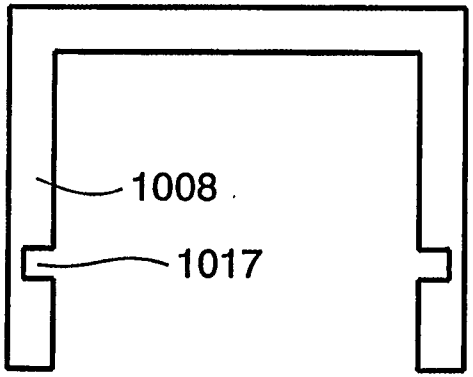
FIG. 39 shows a side view of a collar and a single groove on the inside wall of the collar means for snapping the base element and collar together.
Figure 40:
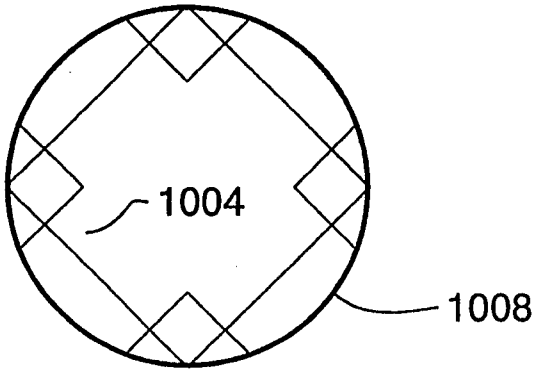
FIG. 40 shows a top view of a collar element showing its top surface having an arbitrary decoration thereon.
Figure 41:
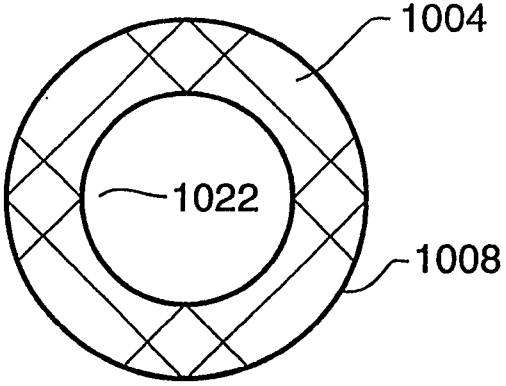
FIG. 41 shows a top view of a collar element showing its top surface having an arbitrary decoration thereon and further having an open top.
Figure 42:
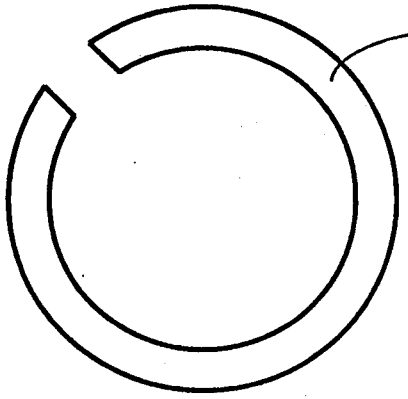
FIG. 42 shows a top view of another embodiment of the collar where it is in the form of a split ring.
Figure 43:
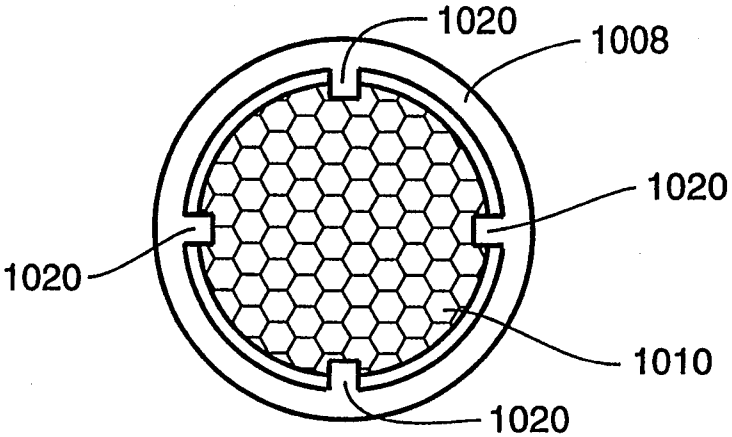
FIG. 43 shows a top view of another embodiment of the collar having an open, see through top, and projections which engage base member, here shown with an arbitrary honeycomb decoration.
Figure 44:
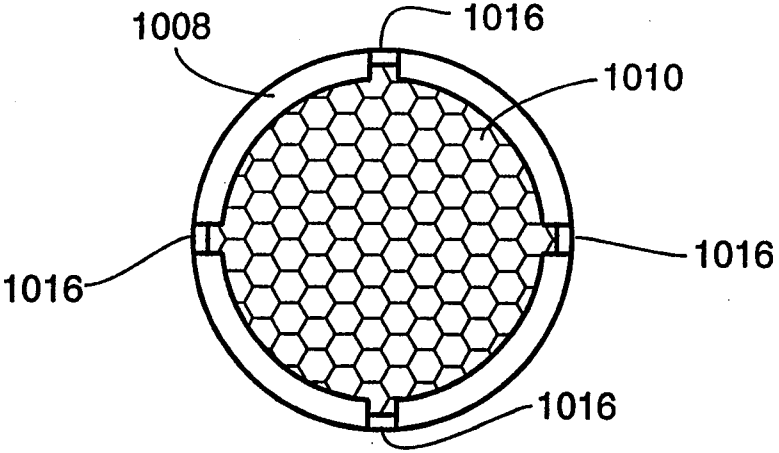
FIG. 44 shows a top view of another embodiment of the invention where the collar has an open, see through top and the base has side wall projections.
Figure 45:
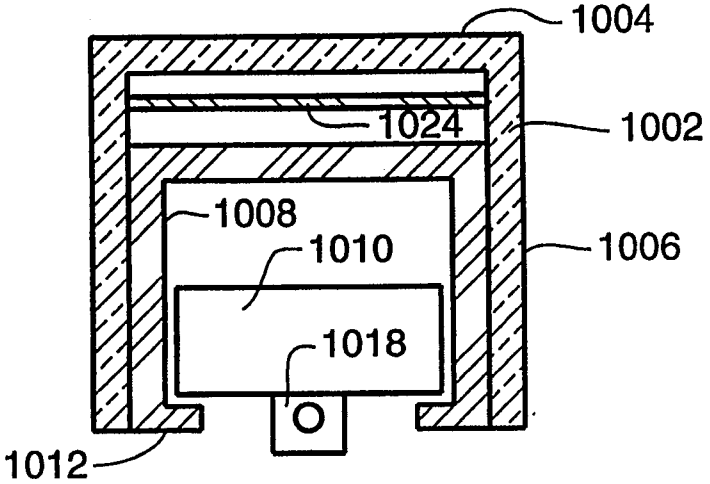
FIG. 45 shows a side sectional view of the invention having an intermediate decorative insert positioned between the collar and cap.
Figure 47:
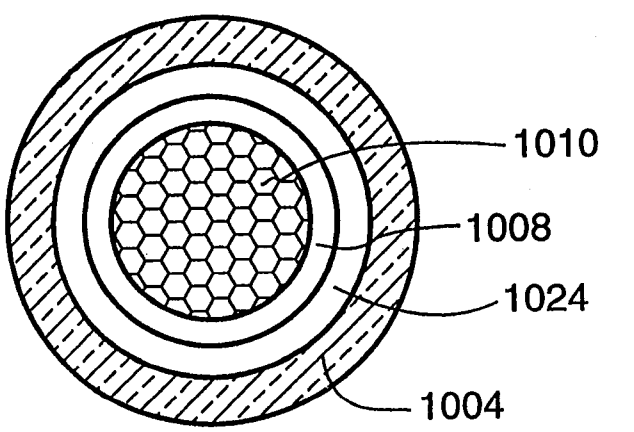
FIG. 47 shows a top view of the assemblage shown in FIG. 45.
Figure 46:
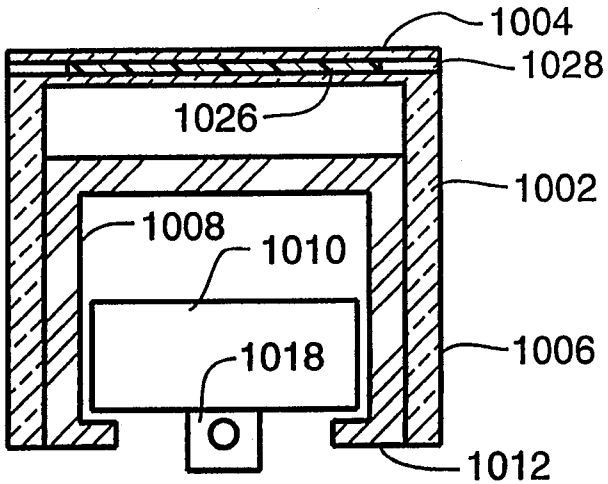
FIG. 46 shows a side sectional view of the invention where the cap has a changeable decorative element.
Figure 48:
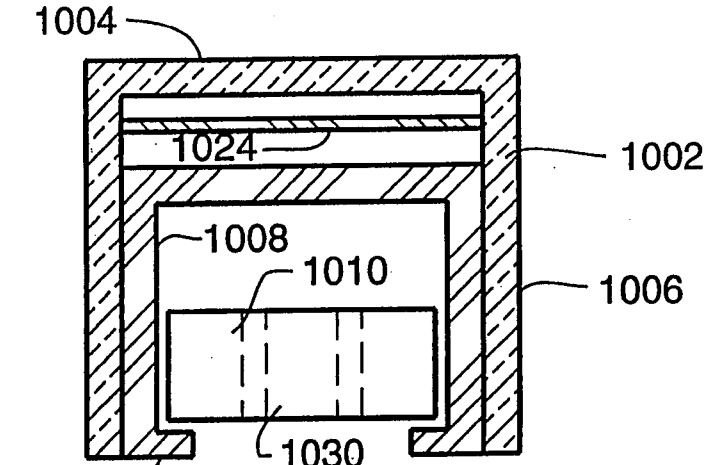
FIG. 48 a side sectional view of the invention having wherein the base has a series of holes for attaching the assembly to a garment by sewing.

This can aid insertion of the collar into the cap element. The collar can also have a finder, not shown, which aids in the automatic inertion of the collar into the cap element. In yet another embodiment, not shown, the opposite end of the collar can have a mirror image protrusion. This would also aid in the automatic inertion of the collar into the cap element since the protrusion on either side could be used and there would be no need for insertion machinery to flip the collar. FIG. 39 shows a side view of a collar 1008 and a single groove 1017 on the inside wall of the collar which cooperates with one or more protrusions around the circumference of the base element. FIG. 40 shows a top view of a collar element showing its top surface 1004 having an arbitrary decoration thereon. FIG. 41 shows a top view of a collar element showing its top surface 1004 having an arbitrary decoration thereon and further having an open top portion 1022 which allows the viewing of the base member therethrough when they are assembled together. FIG. 42 shows a top view of another embodiment of the collar 1008 where it is in the form of a split ring. FIG. 43 shows a top view of another embodiment of the collar 1008 having an open, i.e. see through top, and projections which engage base member, here shown with an arbitrary honeycomb decoration. FIG. 44 shows a top view of another embodiment of the collar 1008 having an open, i.e. see through top. Projections 1016 are integral with the base member 1010, here shown with an arbitrary honeycomb decoration. Projections 1016 engage a groove around the inside wall of the collar. FIG. 45 shows another embodiment of the invention similar to that of FIG. 34 except an intermediate decorative insert 1024 is positioned between the collar 1008 and cap 1002. In this view each of the top cap surface 1004, insert 1024 and the top surface of collar 1008 are at least partially open to permit viewing of the decorative top surface of the cap 1010 therethrough. A top view of such an assemblage is shown in FIG. 47. Each of the top cap surface 1004, insert 1024 and the top surface of collar 1008 are at least partially open to permit viewing of the decorative top surface of the cap 1010. FIG. 46 shows another embodiment of the invention similar to that of FIG. 34 except the cap 1002 has a changeable decorative element 1026 which can slide in a channel 1028 in cap 1002 as shown. FIG. 48 shows an embodiment similar to that of FIG. 45 except the base 1010 does not have a shank, but rather a series of holes 1030 for attaching the assembly to a garment by sewing. Such attachment could just as well be a buckle clasp, a pin, catch, loop, chain, clip, and a myriad of other devices when the assembly is an item of jewelry.

From the above description it will thus be seen that there has been provided new and novel ornamentation in the configuration of button assemblies and jewelry pieces which are constructed from bases, caps and intermediate members which snap together in selected combinations to provide a large and wide variety of ornamentations, jewelry pieces and buttons from a small number of individual members in a simple and efficient manner.

It is to be understood that various features of the individual embodiments may be combined and/or interchanged and need not be precisely employed as shown in these drawings to be within the scope of the invention. For example, any of the above means for attaching the collar to the cap may be combined with any of the means for snapping the base to the collar, any means for attaching the assemblage to a garment, with and without intermediate decorative inserts, and so forth without limitation except as defined by the claims.

It is to be further understood that although I have shown the preferred forms of my invention that various modifications may be made in the details thereof without departing from the spirit as comprehended from the following claims.

What is claimed is:

1. An ornamental assembly comprising:

(a) a hollow cap element having top and side walls, which side walls have inner and outer surfaces which co-terminate at an edge lip;

(b) a collar mating with and attached about the inner surface of the side walls of said cap element at the edge lip, said collar having collar side walls which are substantially parallel to the side walls of the cap element at corresponding points of attachment of the collar to the cap element;

(c) a base element capable of being attached to said collar by means for snapping the base element and the collar together, said base element having base element side walls which are substantially parallel to the collar side walls at corresponding points of attachment of the collar to the base element.

2. The ornamental assembly of claim 1 wherein the collar is attached to the cap element either by means for effecting a removable attachment or by means for effecting a non-removable attachment.

3. The ornamental assembly of claim 1 wherein the base element is attached to the collar either by means for effecting a removable attachment or by means for effecting a non-removable attachment.

4. The ornamental assembly of claim 1 wherein said collar is fixed to said cap element by means selected from the group consisting of a friction fit, crimping the edge lip of the cap element around the collar; an intermediate adhesive; and a heat sealing.

5. The ornamental assembly of claim 4 wherein said intermediate adhesive is a releasable adhesive.

6. The ornamental assembly of claim 1 wherein said collar comprises a split ring.

7. The ornamental assembly of claim 1 wherein said collar comprises a plurality of projections extending from an inside wall of the collar.

8. The ornamental assembly of claim 1 wherein the top wall of said cap element is formed with openings through selected portions thereof to facilitate viewing therethrough.

9. The ornamental assembly of claim 8 further comprising a decorative insert positioned between the cap element and the collar.

10. The ornamental assembly of claim 9 wherein said decorative insert is formed with openings through selected portions thereof to facilitate viewing therethrough.

11. The ornamental assembly of claim 1 wherein the top wall of said cap element is replaceable.

12. The ornamental assembly of claim 1 wherein the collar is formed with openings through selected portions thereof to facilitate viewing therethrough.

13. The ornamental assembly of claim 1 wherein the cap comprises a metal material.

14. The ornamental assembly of claim 1 further comprising means for attaching said base element to an article.

15. The ornamental assembly of claim 1, wherein said means for snapping comprises at least one rib projecting from a wall of either said base element or said collar which engages a groove on the other of said collar and said base element.

16. The ornamental assembly of claim 15 wherein said rib is discontinuous and forms a plurality of spaced latching members.

17. The ornamental assembly of claim 1, wherein said means for snapping comprises a lip carried by said collar which engages the underside of said base element.

18. The ornamental assembly of claim 1 which is selected from the group consisting of a button, a buckle or an item of jewelry.

19. A button assembly which comprises the ornamental assembly of claim 1 and wherein said base element further has means for attaching the base element to a garment, which means for attaching is selected from the group consisting of a shank and a plurality of apertures disposed through the base.

20. A method of producing an ornamental assembly which comprises:

(a) providing a hollow cap element having top and side walls, which side walls have inner and outer surfaces which co-terminate at an edge lip; and (b) providing a collar and matingly attaching said collar about the inner surface of the side walls of said cap element at the edge lip, said collar having collar side walls which are substantially parallel to the side walls of the cap element at corresponding points of attachment of the collar to the cap element; and (c) providing a base element capable of being attached to said collar by means for snapping the base element and the collar together, said base element having base element side walls which are substantially parallel to the collar side walls at corresponding points of attachment of the collar to the base element; and d) snapping together said base element and said collar.

* * * * *